United States Patent [19]

Martin et al.

[11] 4,194,257

[45] Mar. 25, 1980

[54] LIFE VEST SAFETY HARNESS

[75] Inventors: Kenneth R. Martin, Morgan City, La.; Clifford F. Drown, Rte. 1 P.O. Box 670, Morgan City, La. 70380

[73] Assignee: Clifford F. Drown, Morgan City, La.

[21] Appl. No.: 873,485

[22] Filed: Jan. 30, 1978

[51] Int. Cl.[2] ..... B63C 9/08

[52] U.S. Cl. ..... 9/342; 9/313; 182/3

[58] Field of Search ..... 24/163 R; 224/5 BC; 280/179 A; 244/151 R; 9/311, 312, 313, 329, 336, 337, 338, 339, 340, 341, 342; 182/3-9

[56] References Cited

U.S. PATENT DOCUMENTS

| | | | |
|---|---|---|---|
| 1,322,828 | 11/1919 | Salaman | 9/337 |
| 1,409,702 | 3/1922 | Gill | 182/3 |
| 1,841,181 | 1/1932 | Hawie | 24/163 R |
| 2,118,708 | 5/1938 | Johnson | 9/337 |
| 3,416,172 | 12/1968 | Gerling | 9/337 |
| 4,027,255 | 9/1977 | Kiefer | 9/337 |

FOREIGN PATENT DOCUMENTS

| | | | |
|---|---|---|---|
| 1045549 | 10/1966 | United Kingdom | 9/329 |

*Primary Examiner*—Edward R. Kazenske

*Assistant Examiner*—D. W. Keen

*Attorney, Agent, or Firm*—Thomas S. Keaty; Charles C. Garvey, Jr.

[57] ABSTRACT

An improved life vest with an accompanying safety harness is comprised of a life vest body which body is provided with a pliable cushion member mountable about the torso of the wearer. An elongated flexible strap member is secured about the outer surface of the cushion member. One end portion of the strap member is provided with a slipping type buckle (such as a pair of D-rings). The opposite end portion of the strap member is supplied with a suitable connection member such as a hook. There can be further provided a stop member on the strap which limits the degree of constriction which can be achieved by the strap about the vest. Alternatively, the stop could be ommitted, and extra padding in the life vest body utilized to prevent injury to the wearer during constriction of the device. The device is especially suited for offshore use with, for example, personnel transfer nets where (or like elevated structures) the hook member can be secured into the netting of the transfer net thereby preventing injury or death to the wearer after an inadvertent fall from the net or like elevated structure.

10 Claims, 5 Drawing Figures

LIFE VEST SAFETY HARNESS

BACKGROUND OF THE INVENTION

1. Field of the Invention

The present invention related to life vests, and more particularly relates to a life vest which is equipped with an improved safety harness structure useful for example in offshore drilling platforms and life environments, the harness providing attachment to a suitable secure member thereby preventing injury after an inadvertent fall of the wearer, while not unduly restricting the wearer's normal activity.

2. General Background and Prior Art

In the offshore area of Louisiana, oil workers and the like are required by governmental regulations and by good safety practice to wear at all times a life vest which can be made of a pliable buoyant material. These life vests are bulky and cumberson, bur are a necessity since the workers are always exposed to the threat of drowning if they fall into the Gulf waters below. This problem exists in similar offshore oil or industrial areas such as the North Sea, the West Coast, the Mideast, and the like.

A further danger is seen in that many offshore workers work on rigs, fixed platforms, drilling platforms, derrick barges, and like structures which can be elevated a great distance above the water surface. Such offshore workers are required to wear the pertinent buoyant life vest in order to save them from drowning, but this is of little utility if the man falls from a high elevation such as one hundred plus feet before impact.

It is to this problem that the present invention is directed. Often, a worker in the offshore environment will be required to expose himself to falling from great heights while is is performing a particular task. In addition, the standard for transferring men from crew boats to the particular offshore structure is a conventional "personnel net". These nets are comprised generally of a pair of rigid ring members and have a cross-work matrix of ropes forming a netting therebetween. The personnel transfer nets are equipped with an upper lifting eye to which a crane mounted on the offshore structure attaches a liftline for raising the personnel net from the deck of the crew boat to the structure. This transfer can often be over a great vertical distance. Thus, there is the danger that an individual riding the personnel net could fall and injure or kill himself. Further, the problem of riding the net without injury is compounded by the problem of adverse weather conditions such as high winds which may rock the net from side to side or hold it suspended at a substantial angle with the vertical. Such a phenomenon is seen especially where only one individual rides the net and its weight is not sufficient to hold the net in its normal vertical position. This would particularly be a problem in the North Sea area where weather is often foul and accompanied by high winds.

In summary, passengers have fallen from personnel transfer nets for the following reasons:

1. Fear of the height;
2. Feet slipping from the bottom ring and failing to maintain hand hold on rope webbing;
3. Violent motions of basket due to gusting winds; and
4. Incompetent operation of lifting crane.

It should be understood that each person who travels out to a rig on a crew boat is required or should at least wear a life vest in order to save himself from drowning in the event he would fall into the water. Likewise, such life vests of cushioned pliable foam or like buoyant material are worn by the offshore workers as they travel from the crew boat to the platform on the personnel nets.

The worker may be exposed to falling from heights in other areas about an offshore rig or like structure, such as working along the upper railings as may be experienced for example by a painter who is applying paint to the railings of a drilling rig or similar structure which are exposed to the corrosive salt atmosphere of the offshore environment.

U.S. Pat. No. 1,322,828 (G. Salaman), provides a "Device for use in Saving Life at Sea." The Salaman device consists of a tubular ring flotation device similar to the common life ring. This device incorporates a strap which is used to secure the individual to the device and has the dual purpose of securing the individual to another person or object in the water. It is apparent that the device has the primary function to be used in case of abandonment of ship by a person who must go into the water, rather than being used by a person who might possibly fall into the water by accident. The design of the strap is insufficient to support an individual at the end of a fall and also keep any bodily injury to a minimum. Further, no cooperative structural relationship exists between the tubular flotation ring and strap in contemplation of withstanding such a force or jar.

U.S. Pat. No. 3,452,374 (J. W. Turner), provides a "Thigh Type-Weather Deck Survival Restraint Harness." The Turner device has a complicated series of straps that could take a substantial amount of time to put on, especially if the device was left laying loose on the floor and then picked up to put on by an untrained individual. Item would be most likely unacceptable to safe operating procedures due to the strap complexity. This device also does not provide a restraining strap of safety line as part of the harness to prevent the wearer from being swept overboard or falling, although it does provide rings for securing the wearer in the cockpit of an aircraft. This device would be almost impossible for use in the offshore oil or construction industry due to its complicated nature and the lack of training of the typical offshore worker.

General Discussion of the Present Invention

The present invention provides a simple and inexpensive structure for attachment to a life vest, the overall combination providing a life vest and safety harness which solves the prior problems of offshore workers who are exposed to dangerous heights. The present invention provides an outer life vest body of a pliable cushioned nature which is mountable about the torso of a wearer. An elongated flexible strap member is provides on the life vest and encircles it so as to form a constricting and attaching loop. A slip-type buckle is provided at one end portion of the strap member, the buckle providing a sliding connection for the opposite end portion of the strap such that an adjustable sliding constriction can be maintained about the life vest and the torso of the wearer therein. If desired, a stop can be provided on the strap for limiting the degree of contriction of the loop so as not to put extraneous stress on the torso of the individual therein. However, the cushioning effect of the outer vest provides primary protection to the torso, the "stop" being an optional feature.

The end portion of the strap opposite the buckle is provided with a hook or other suitable attachment means for securing the strap at that end portion to a secure object such as the netting of a personnel transfer net, the railing of an offshore oil platform, or a safety wire line arranged at an elevated level on any structure upon which the individual is working. The device will snare and hold the individual in the event of an inadvertent fall with the hook and strap member providing the necessary tensile strength to suspendedly catch and hold the individual after the fall. The sliding buckle will cause the noose to tighten up about the individual so that slippage of the strap and its formed loop off the torso of the individual will not be a problem. The stop member if provided, would limit the degree of constriction of the loop formed by the strap and buckle, thus, preventing injury to the torso of the wearer in the event of a sudden abrupt free fall.

Accordingly, it is an object of the present invention to provide an offshore worker with an improved life vest and safety harness to negate the possibility of inadvertent falling and give the required degree of safety to the worker over water.

A further object of the present invention is to provide the user with a flotation device and safety harness while on board a marine vessel that can be utilized to attach the user to a lifting device which will transfer him up to an offshore structure from the marine vessel or back thereto.

A further object of the present invention is to provide the user with a combined and compatible flotation device and safety harness assembly without unduly restricting mobility of the user, or burdening the user with constant changing from one device to the other as the need develops.

Still another object of the present invention is to provide a device with small bulk and simplicity of design that can be readily be used by the wearer without the need of complex procedure or advance instruction.

Still another object of the present invention is to provide a device which can be adapted easily to existing life vests or similar flotation devices worn presently by a large number of offshore oilfield and like workers.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENTS

Figure 1:
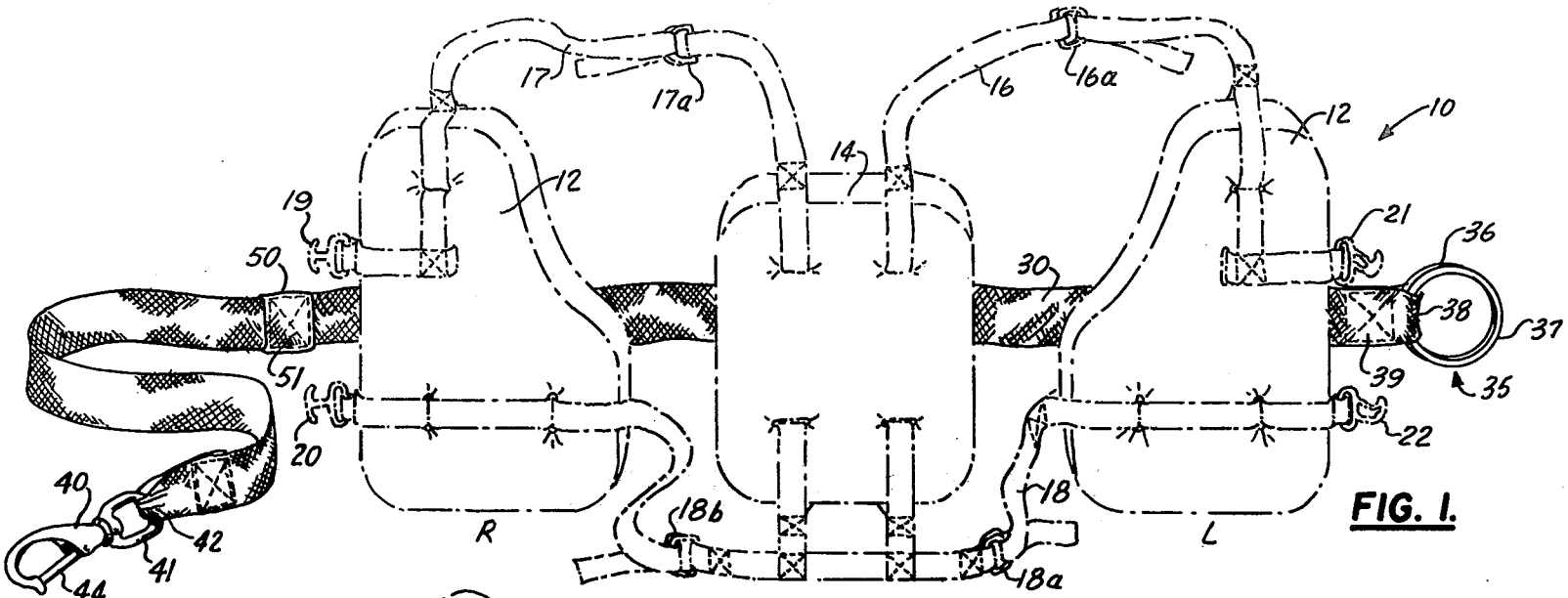
FIG. 1 is a front perspective view of the preferred embodiment of the apparatus of the present invention with the life vest portion being shown in phantom lines.
Figure 2:
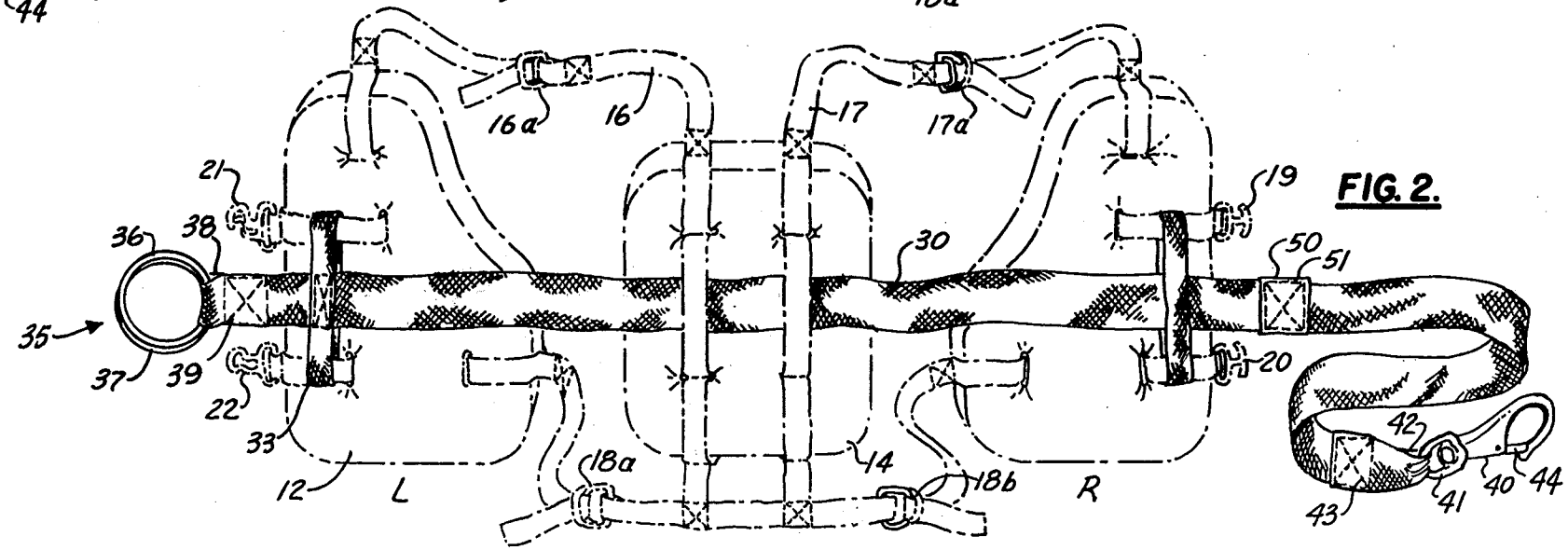
FIG. 2 is a rear portion of the preferred embodiment of the apparatus of the present invention with the life vest portion being shown in phantom lines.
Figure 3:
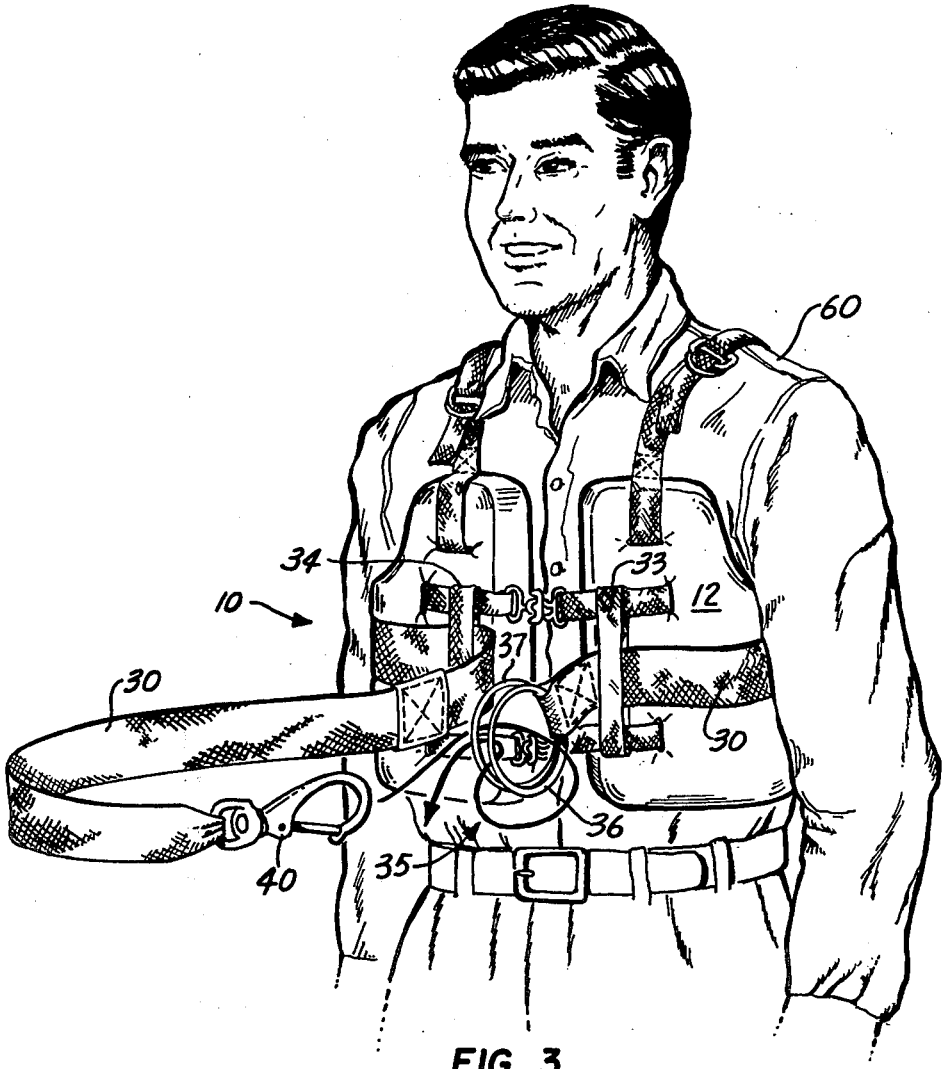
FIG. 3 is a perspective view of the preferred embodiment of the apparatus of the present invention shown on the torso of a wearer, with further illustration showing the method of attaching and securing the assembly.

FIGS. 1 and 2 illustrate with particularity the structure of the preferred embodiment of the apparatus 10 of the present invention. As can best be seen in FIGS. 1 and 2, there is seen a life vest structure which is comprised of a pair of side panels 12 and a center panel 14. Each panel 12, 14 is manufactured of a pliable cushion-like material such as foam rubber. The foam rubber panels 12, 14 are connected by a series of straps as can best be seen in FIGS. 1 and 2. There is provided a pair of shoulder straps 16, 17 and a lower belt strap 18. Each strap member 16, 17, 18 is provided with an adjustable D-ring structure for adjusting the straps to fit the needs and size of the individual wearer. The D-ring adjustments are shown in FIGS. 1 and 2 as **16*a*, 17*a*, 18*a* and 18*b* for the left shoulder, right shoulder, and belt strap members respectively. There is further provided a plurality of buckle members 19–22 which interconnect in order to fasten the life vest about the torso of the wearer. A pair of upper buckle members 19, 21 are also provided and a pair of lower buckle members 20, 22 are also provided on the vest structure shown in FIGS. 1 and 2. In FIG. 3**, these buckle members can be seen in a fastened position. Such a lift vest is connectional and available through various marine outlets, being presently in use among other places in the Louisiana Offshore Oil Environment and used by offshore companied such as Offshore Drilling and Exploration Company (ODECO),, J. Ray McDermott, Inc., Avondale Shipyards, and like organizations.

There can be seen in FIGS. 1 and 2 an elongated strap 30 which is attached permanently to the shoulder strap 16, 17 as can best be seen in FIG. 2. Strap 30 can be attached to shoulder strap 16, 17 by means of stitching or like known connections at point 31, 32 (see FIG. 2). One end portion of strap 30 is provided with a buckle member 35. Buckle member 35 is preferably comprised of a slip-type nature and can be for example a pair of circular rigid rings 36, 37.

A hook member 40 is attached to the end portion of strap 30 opposite the end to which buckle member 35 is affixed. Buckle member 40 can be mounted on a swivel eyelit 41 which is attached by means of loop 42 to strap 30. A suitable connection can secure loop 42 such as the stitched connection 43 shown in FIG. 2. Hook member 40 can be provided with a pivotal closure member 44 which will allow hook 40 to be attached to a desired secured member for the prevention of a fall of the wearer in the event he may slip (see FIG. 5). Closure member 44 can be spring-loaded so as to maintain a closed ring after the hook member 40 is secured to the desired object.

In FIGS. 1 and 2 there can be further seen a stop member 50 provided on strap 30. Strap 50 can be simply an enlarged thickness in strap 30 which is formed by adding additional strap material, or merely folding the strap in an "S" pattern and thereafter affixing by stitching or the like. In the preferred embodiment shown in FIGS. 1 and 2, an additional strap material is added to the existing strap 30 so as to provide a thickened area. This thickened area will prevent the constriction of the loop formed about the torso of the wearer when buckle 35 slips on strap 30 in a constricting manner when force is applied to the end portion of the strap adjacent the hook such as may occur during a fall of an individual (see FIG. 5). The stop member can be located at a desired distance along strap 30 so as to allow constriction of the loop formed about the torso of the wearer to a degree which will compress the flexible cushioned panel members 12, 14 a small amount thereby insuring a good grip on the torso of the wearer 60 in the event of a fall. Such a slight constriction of the outer life vest panels 12, 14 will prevent slippage of the loop formed allowing the wearers 60 to escape from the loop.

FIG. 3 illustrates the method of attaching the end portion of strap 30 opposite buckle 35 to buckle member 35 by interweaving it through rings 36, 37. The buckle 35 provided with the present invention in combination with the substantially flat strap member 30 provides a connection which will allow the strap to slip through the rings in a fashion which will gradually tighten the strap 30 about the torso of a wearer 60 so as to form a loop about the torso of the wearer and the life vest panels 12, 14.

It should be understood that the apparatus 10 of the present invention can operate or with other similar elevated structures to prevent death or injury in the event of an inadvertant fall, if hook member 40 is attached to a supportive structure as is taught herein.

Figure 4:
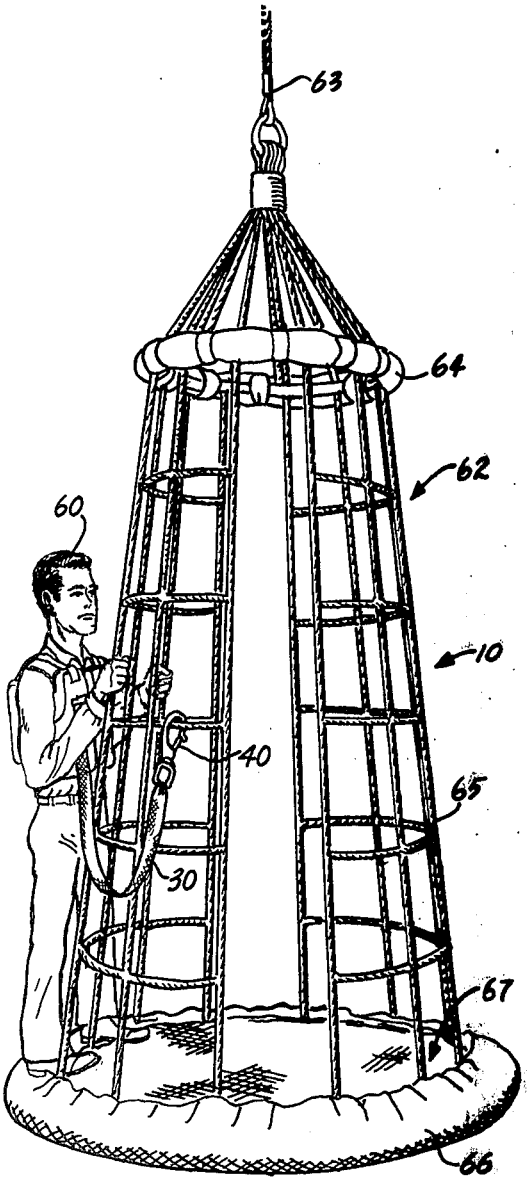
FIG. 4 is a front view of a typical offshore personnel net illustrating a user of the preferred embodiment of the apparatus of the present invention attaching the hook portion of the device to the personnel transfer net during a transfer.
Figure 5:
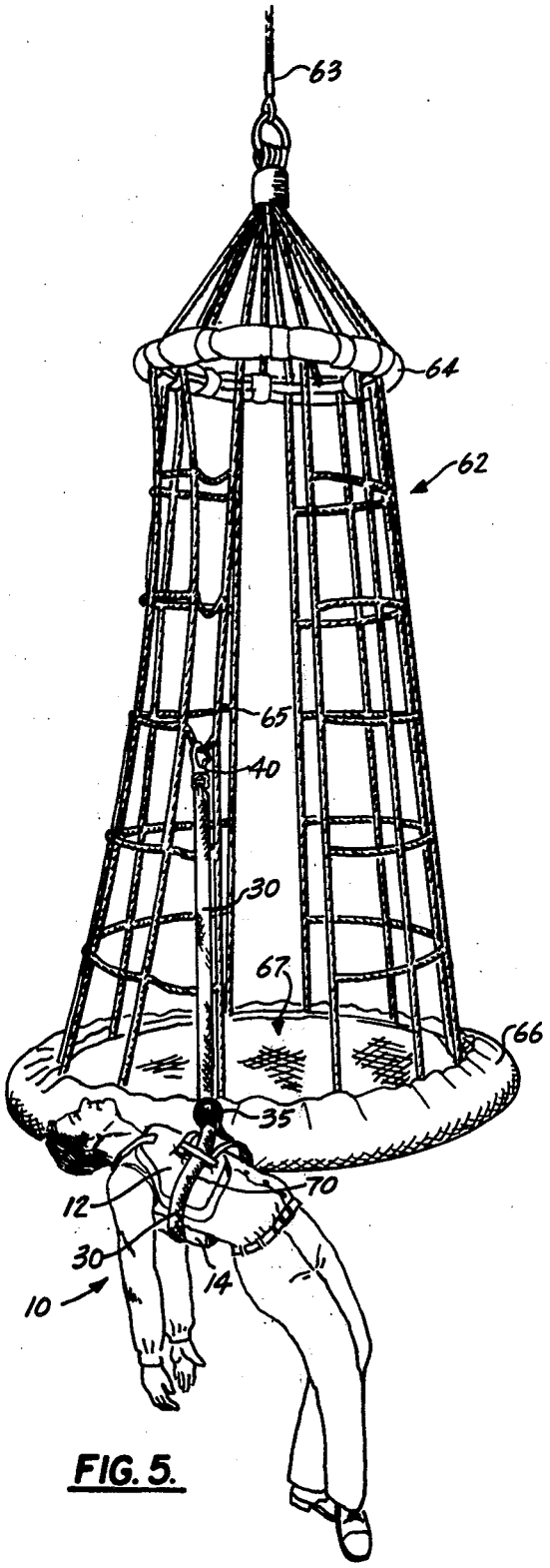
FIG. 5 shows a front view of a typical offshore personnel transfer net with the preferred embodiment of the apparatus of the present invention hooked into the personnel net and the individual being shown in a suspended state after falling from the net structure.

FIGS. 4 and 5 illustrate the operation of the preferred embodiment of the apparatus of the present invention with a standard offshore personnel transfer net. In FIG. 4, there can be seen an individual 60 wearing the life vest 10 of the present invention and having secured the strap 30 about his torso so as to form a loop 70 thereabout. Note the interconnection of the end portion of strap 30 through buckle member 35 as was illustrated in FIG. 3. The wearer 60 then attaches hook member 40 to the desired secure object which is (in FIGS. 4 and 5), a portion of the ropes 65 forming the net portion of the offshore personnel transfer net. The personnel net 62 is being lifted by means of a cable 63 which can be, for example, attached to the end portion of a crane or like mechanical device for raising the personnel net 62 from the deck of a crew boat to the elevated surface of the rig. The attachment of hook member 40 to such a supportive structure as the ropes 65 of net 62 prevent fall beyond a short distance when the wearer 60 slips or otherwise loses control of his position on the net or like structure upon which he is working, riding, or the like. The personnel net 62 is comprised of an upper ring 64 and a lower ring 66 and is interlaced with a plurality of rope members 65. A lower riding platform 67 is provided so that individuals can stand thereon during transit.

In FIG. 5, there is illustrated the operation of the preferred embodiment of the apparatus of the present invention after an inadvertent fall by wearer 60 from net 62. In FIG. 5, it can be seen that hook member 40 is secured to a rope member 65 of net 62. The elongated strap 30 and hook 40 provide necessary tensile force to suspend the wearer from the net in the event of such an inadvertent slip. Note that a loop 70 has been formed by the strap 30 about the torso of the wearer 60 which loop encircles the life vest panels 12, 14 and slightly constricts them before buckle 35 hits stop 50. Stop 50 can be provided to eliminate the change of excessive constriction of the loop 70 formed by strap 30 and buckle 35, which excessive constriction could cuase injury to the ribs or chest area if the fall were overly violent. The "slip" nature of buckle 35 in combination with the cushioning effect of panels 12, 14 provides a "shock absorbing" effect to cushion the falling wearer. The stop 50 could be pre-placed on strap 30 so as to allow a constriction of loop 70 about the torso of the wearer enough to grip the torso sufficiently as to prevent its escape therefrom, but not so extreme as to damage the chest area by exerting a crushing effect thereon.

Straps 30 could be pre-sized such as conventional belts are pre-sized for their wearers which are pre-sized in waist sizes of for example 30 inches, 32 inches, 36 inches, etc. A convenient pre-sizing of straps 30 could correspond to chest circumference, giving sizes such as 38 inches, 40 inches, 42 inches, and like measurements with graduations every two inches allowing proper selection to variations between individuals. An extra length of for example three to four feet is provided to each strap 30. The extra length is indicated as 31 in FIG. 5 and being the extra portion of strap provided to the strap other than that portion needed to form loop 70 and further being the portion shown in FIG. 5 between buckle 35 and hook member 40. This extra "suspending member" portion 31 of strap 30 must be of a length as not to excessively limit the normal activity of an offshore worker such as a welder, painter, or the like who may be working in an outer area of a rig for example, over water. However, the length of suspending member 31 portion of strap 30 must not be so long as to encumber the wearer 60, or let him fall (before stopping the fall) an excessive distance. An extra length of three to four feet as aforementioned is acceptable.

Strap 30 could be constructed from a suitable web strap material such as nylon, canvas or the like having a sufficiently high tensile strength to withstand the stress of a man falling through a distance of three to four feet. A tensile strength of five thousand pounds would be acceptable, and such strap material easily available to one skilled in the art.

If a life vest were manufactured providing very flexible and sufficiently cushioning panels 12, 14, a stop 50 would not be required in order to restrict the degree of closure of the loop 70. In such a case, the cushioning effect of the panels 12, 14 themselves would prevent injury to the torso of the wearer 60 from the object on which he was riding or working.

The apparatus 10 of the present invention could be used in a variety of circumstances other than the personnel transfer net shown. The device could be used for example by welders and steel workers working on scaffolding over the side of ships, by rig workers inspecting the sub-structure of a platform or rig at sea for damage or indications of stress, or by seamen on offshore supply vessels for security while tying up to a rigs leg in heavy weather. (The seaman must transmit the length of the vessel to reach his mooring station). These are of course exemplary and not exhaustive of the situations in which the device could operate.

Because many varying and different embodiments may be made within the scope of the inventive concept herein taught, and because many modifications may be made in the embodiments herein detailed in accordance with the descriptive requirements of law, it is to be understood that the details herein are to be interpreted as illustrative and not in a limiting sense.

What is claimed as invention is:

1. A safety fall prevention harness for use with a life vest, comprising:

a. an elongated flexible strap member;

b. means for securing said strap member to a conventional life vest, with said strap encircling and grasping the life vest and the human wearer;

c. buckle means at one end portion of said flexible strap member, said buckle means providing a slideable connection forming an adjustable loop with said strap about the life vest and the torso of the wearer; said strap contacting the outer surface portion of the life vest during operation; and d. affixing means at the opposite end portion of said strap from said buckle means for affixing the end portion of said strap adjacent said affixing means to a desired point of security, said buckle means sliding to constrict said adjustable loop about the life vest when tensile force is applied to said affixing means as when the human wearer inadvertently falls.

2. The apparatus of claim 1, further comprising stop means on said strap member for limiting the degree of constriction of said encircling loop formed by said strap member about the life vest.

3. The apparatus of claim 2, wherein said stop means is a thickened section of said strap.

4. The apparatus of claim 1, wherein said strap member is attached at intervals to the outer surface of said life vest.

5. A life vest with accompanying safety harness wearable about the torso of an individual, said apparatus comprising:

a. a life vest body, said body comprising:

i. a pair of front life vest panels, each of said panels being of a pliable resilient cushioned material;

ii. a rear life vest panel, said rear life vest panel being of a pliable, resilient, cushioned material, and said pair of front vest panels and said rear panel being connected by a plurality of belts forming an entire wearable life vest assembly attachable to the torso of a wearer, said life vest assembly being of a buoyant nature;

b. an elongated flexible strap member encircling said life vest body, said strap member being of a high tensile strength material;

c. a hook member attachable to one end portion of said strap member, said hook member having a pivotal closure member mounted thereon, said closure member being spring-loaded to urge said closure element into a normally closed position forming an entire closed hook member, said hook member being attachable to a desired point of security by operation of said pivotal closure element;

d. a buckle member attached to the opposite end portion of said strap member from said hook member, said buckle comprising a pair of substantially circular rigid rings, said hook member and the portion of said strap member attached thereto being threadable through said buckle to form an attachment of said strap member to said buckle, the connection of said strap member to said buckle forming a slip-type connection, the continued application of tensile force to said hook member gradually constricting the loop formed by said buckle attached to a portion of said strap member.

6. A life vest wearable about the torso with accompanying fall prevention harness, comprising:

a. a life vest body, said body providing a pliable cushioned member mountable about the torso of the wearer;

b. an elongated flexible load carrying strap member attachable to said life vest body about the periphery thereof, and forming an encircling loop about said life vest body;

c. means at one end portion of said strap for affixing the end portion of said strap to a desired point of security; and d. buckle means at the end portion of said flexible strap member, opposite said affixing means for forming a loop with said strap, said buckle means providing a slideable connection with a portion of said strap, said slideable connection forming an adjustable constrictable loop with said strap for gripping said life vest body and the enclosed torso of the wearer.

7. The apparatus of claim 6, further comprising stop means for limiting the degree of constriction of said encircling loop formed by said strap member about said vest body.

8. The apparatus of claim 7, wherein said stop means is a thickened section of said strap.

9. The apparatus of claim 7, wherein said stop means is located on said strap at some position which allows some constriction of said cushion member by said encircling loop during the closure of said loop before said stop means haults further constriction of said loop.

10. The apparatus of claim 6, wherein the application of a tensile force to said affixing means as in the case of an inadvertent fall likewise imparts a tensile force to said flexible strap member causing said buckle means to slip along a portion of said strap means constricting said loop about said life vest body and the torso of the wearer of said life vest body.

* * * * *